US005235887A

United States Patent [19]

Moriya

[11] Patent Number: 5,235,887

[45] Date of Patent: Aug. 17, 1993

[54] CUTTER APPARATUS

[75] Inventor: Mikio Moriya, Tokorozawa, Japan

[73] Assignee: Citizen Watch Co., Ltd., Tokyo, Japan

[21] Appl. No.: 908,908

[22] Filed: Jul. 2, 1992

Related U.S. Application Data

[63] Continuation of Ser. No. 668,982, Mar. 12, 1991, abandoned.

[30] Foreign Application Priority Data

Mar. 22, 1990 [JP] Japan ..... 2-30257[U]

[51] Int. Cl.[5] ..... B26D 5/42; B26F 1/18; B41J 11/70

[52] U.S. Cl. ..... 83/282; 83/140; 83/143; 83/386; 83/628; 83/660; 83/695

[58] Field of Search ..... 83/140, 143, 387, 389, 83/582, 628, 282, 375, 386, 388, 370, 660, 695

[56] References Cited

U.S. PATENT DOCUMENTS

| | | | |
|---|---|---|---|
| 978,535 | 12/1910 | Armstrong | 83/282 |
| 4,358,979 | 11/1982 | Kurzbuch | 83/140 |
| 4,936,177 | 6/1990 | Ozawa et al. | 83/628 |

FOREIGN PATENT DOCUMENTS

| | | | |
|---|---|---|---|
| 54981 | 4/1967 | German Democratic Rep. | 83/389 |
| 58-86362 | 6/1983 | Japan . | |
| 59-9835 | 1/1984 | Japan . | |
| 94591 | 2/1939 | Sweden | 83/387 |
| 778953 | 11/1980 | U.S.S.R. | 83/387 |
| 1373201 | 11/1974 | United Kingdom | 83/582 |

*Primary Examiner*—Hien H. Phan

*Attorney, Agent, or Firm*—Dickstein, Shapiro & Morin

[57] ABSTRACT

A cutter apparatus having a fixed blade in an opening of a paper feeding guide; and a movable blade having a cutting portion which enters into the opening. A paper holding plate is provided on the movable blade slidably in the cutting direction. The distal end of the paper holding plate is kept projected by a sliding mechanism in the cutting direction from the distal end of the cutting portion of the movable blade. With the paper holding plate firmly holding the paper against the feeding guide, the sliding mechanism further moves the movable blade into the opening. On carrying out the cutting operation, firstly the paper holding plate slidingly reaches the recording paper and tightly keeps the paper stationary. Thereafter the cutting portion of the movable blade moves forward enters into the opening to cut the paper. The result is that the recording paper does not escape when undergoing the cutting operation, the cutting quality can be kept excellent to a certain extent irrespective e.g. of the condition of the movable blade.

5 Claims, 4 Drawing Sheets

CUTTER APPARATUS

This application is a continuation of application Ser. No. 668,982, filed Mar. 12, 1991, now abandoned.

BACKGROUND OF THE INVENTION

1. Field of the Invention:

This invention relates to a cutter apparatus for cutting recording paper or the like, and more particularly to a cutter apparatus used typically in accounting registers, printers, meal ticket vending machines etc.

2. Description of the Related Art:

FIG. 4 of the accompanying drawings shows a schematic view of a conventional cutter apparatus as disclosed in Japanese Utility Model Laid-Open No. 86362/1983 or Japanese Utility Model Laid-Open No. 9835/1984.

In FIG. 4, a carrier guide 10 for carrying recording paper 12 has a fixed blade 10 formed in an opening 14. A movable blade 16 having a cutting portion 18 is driven by a not shown driving mechanism in the cutting direction A as shown in FIG. 5, and its cutting portion 18 enters into the opening 14. The recording paper 12 is sequentially fed in the direction B by a not shown feeding mechanism.

Thus the recording paper 12 located between the fixed blade 10 and the movable blade 16 will be cut by the movable blade 16 being driven in the direction A.

However, such a conventional cutter apparatus had the disadvantage of easily causing a bad cutting operation. When the cutting quality at the cutting portion 18 of the movable blade 16 becomes dull e.g. by repeated cutting operations, the recording paper 12 would be pressed into the opening 14 and remaining uncut.

Such an inconvenience tends to occur particularly in cases of:

(1) the recording paper 12 being excessively thick or thin;

(2) the recording paper being humid under certain atmospheric conditions;

(3) the cutting portion 18 of the movable blade 16 being obsolescent.

SUMMARY OF THE INVENTION

It is therefore an object of this invention to provide a cutter apparatus which is capable of producing excellent and stable cutting quality irrespective of: the types of recording paper; the atmospheric conditions; or the obsolescence of the cutting portion of the movable blade, thereby providing improved durability.

According to this invention, a cutter apparatus having: a fixed blade provided in a striation-like opening formed across the width of a paper feeding guide; and a movable blade having a cutting portion which enters into said opening, said fixed blade and movable blade cooperating to cut or to form a perforated line on the paper located therebetween, said cutter apparatus comprising:

(a) a paper holding plate provided on said movable blade to be slidable in the cutting direction of the movable blade;

(b) a sliding mechanism which: keeps the distal end of said paper holding plate projected in the cutting direction from the distal end of the cutting portion of said movable blade; slides the movable blade and the paper holding plate in the cutting direction; and with the paper holding plate firmly holding the paper against the feeding guide, further slides the movable blade into the opening;

(c) an energizing or urging means for urging said paper holding plate continuously in the direction of cutting motion.

In this invention, on cutting the recording paper, firstly the paper holding plate reaches the recording paper and tightly keeps the paper stationary. With this state, the cutting portion of the movable blade continues forward moves and enters into the opening to cut the paper. This means that the paper does not escape undergoing the cutting operation by the movable blade, thereby improving the cutting quality to a certain extent irrespective of the state of the movable blade.

The above and other advantages, features and additional objects of this invention will be manifest to those versed in the art upon making reference to the following detailed description and the accompanying drawings in which the principles of this invention are shown by way of example.

DETAILED DESCRIPTION

Figure 1:
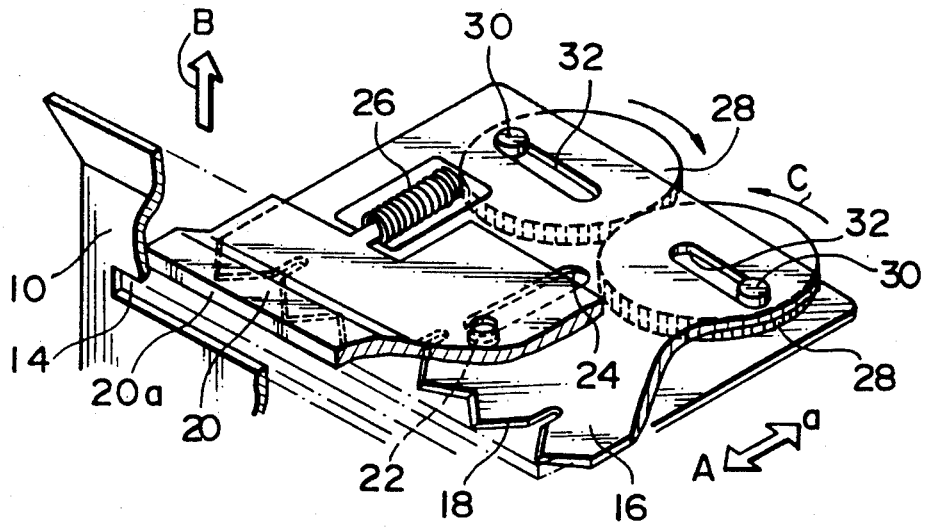
FIG. 1 is a schematic perspective view of a cutter apparatus according to an embodiment of this invention, with portions partially cut out.

The principles of this invention are particularly useful when embodied in a cutter apparatus, such as shown in FIG. 1.

Figure 4:
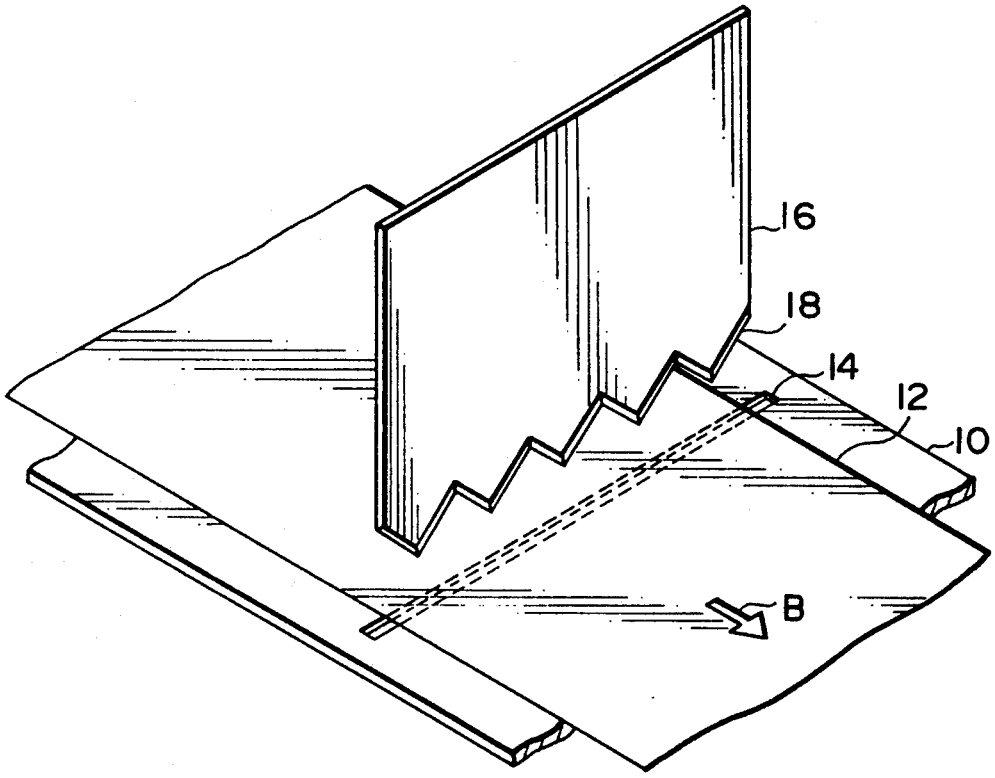
FIG. 4 PRIOR ART
FIG. 4 is a schematic view showing a conventional cutter apparatus.
Figure 5:
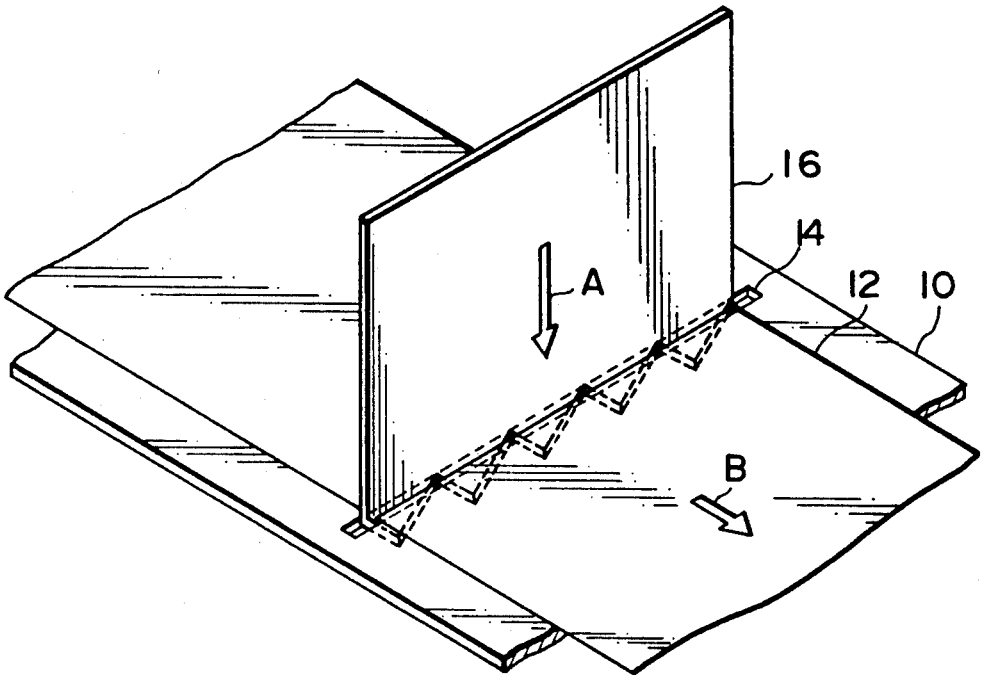
FIG. 5 PRIOR ART
FIG. 5 is a schematic view showing operation of the conventional cutter apparatus.
Figure 6:
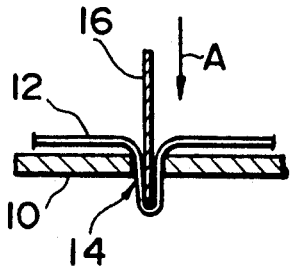
FIG. 6 PRIOR ART
FIG. 6 is a explanatory drawing showing the disadvantage arising in the conventional cutter apparatus.

FIG. 1 is a schematic perspective view of a cutter apparatus according to an embodiment of this invention, some portions of which are partially cut out. Some numerals designate the same component as in FIG. 4, and their explanations are omitted.

Figure 2:
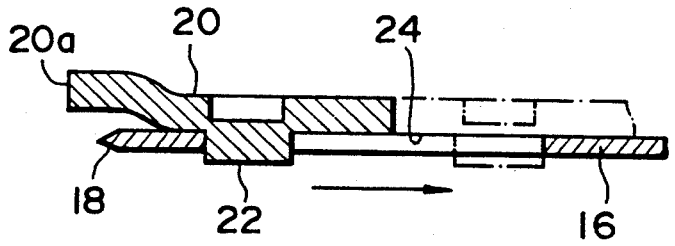
FIG. 2 is a side sectional view showing a sliding mechanism in FIG. 1.

In FIG. 1, a paper holding plate 20 being the first characteristic component of this invention is mounted on one side of the movable blade 16 slidable in the cutting direction A. Such a sliding mechanism is, as in FIG. 2 showing the side sectional view of FIG. 1, composed by a half blanking dimple 22 formed by projecting a part of the paper holding plate by half blanking process and a guide hole 24 formed by applying a cutting process in a part of the movable blade 16. In the stand-by state, the distal end 20*a* of the paper holding plate 20 remains forwardly projected for a predetermined amount from the distal end of the cutting portion 18 of the movable blade 16.

A compression coil spring 26, the second characteristic component of this invention, energizes the paper holding plate 20 always in the cutting direction A. Although the other one is omitted in FIG. 1, a pair of the compression coil springs 26 are provided on both sides of paper holding plate 20.

A pair of driving gears 28 for driving the movable blade 16, when making one rotation through a not shown driving motor or a manual lever in the direction C, perform one cutting operation of the movable blade 16. Namely, each of the driving gears 28 has a driving pin 30 projectingly mounted thereon. These driving pins 30, within a driving guide hole 32 formed on the movable blade 16, move in accordance with the rotation of the driving gears 28, whereupon the movable blade 16 starts being driven in A-a direction.

Figure 3:
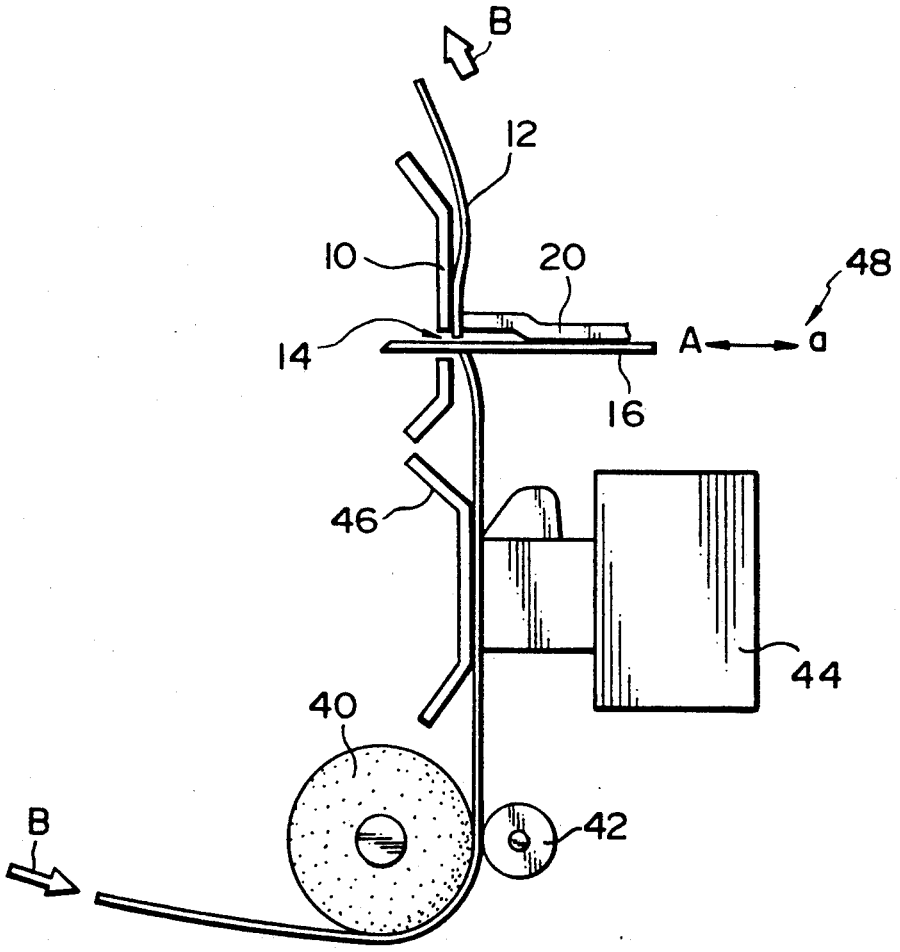
FIG. 3 is a schematic view of a printing system of an accounting register incorporating the cutter apparatus according to this invention.

FIG. 3 is a schematic view of the printing system of an accounting register incorporating the cutter apparatus according to this invention.

In FIG. 3, the recording paper 12 e.g. in rolled-form is fed in the direction B by means of a paper feeding roller 40 and a press roller 42, and passes through the printing section composed of a printing head 44 and a platen 46 etc., and thus reaches the cutting section 48.

The cutting operation at the cutting section 48 will now be described referring to the FIGS. 1-3.

During the stand-by state i.e. the recording paper 12 being fed, the movable blade 16 and the paper holding plate 20 are in the stand-by state, namely, located at a position not disturbing the paper from being passed through. At this time, the half blanking dimple 22 of the paper holding plate 20 is pressed forward in the cutting direction A within the guide hole 24 by means of the compression coil spring 26, thereby its distal end 20*a* becomes positioned adjacent to the recording paper 12 with a slight gap therebetween.

Upon completion of the predetermined printing process, the paper cutting operation will start. The recording paper 12 is fed for a predetermined amount by the paper feeding roller 40. After this feeding operation is stopped, the movable blade 16 is moved, together with the paper holding plate 20, toward the cutting operation in direction A by the driving gear 28. At this time, the distal end 20*a* of the paper holding plate 20 comes into contact with the carrier guide 10 through the recording paper 12, and thus the recording paper 12 is tightly held by the energizing or urging force of the compression coil spring 26 between the distal end 20*a* and the carrier guide 10. Meanwhile, however, the movable blade 16 continues moving toward the cutting operation in direction A, even after said contact takes place.

This movement of the movable blade 16 increases the energizing or urging force of the compression coil spring 26, resulting in the recording paper 12 being strongly and firmly held by the paper holding plate 20.

With the recording paper 12 being fixed in such a manner, the cutting operation by the movable blade 16 will be carried out.

In this cutting operation, as mentioned above, the recording paper 12 is tightly fixed by the paper feeding roller 40 and the paper holding plate 20. Therefore, the movable blade 16, on entering into the opening 14, scarcely draws out the paper 12 from the paper feeding roller 40 side or from the paper holding plate 20 side, nor presses the drawn paper into the opening 14, leaving the paper 12 uncut. In other words, the pressing force of the movable blade 16 acts quite effectively as cutting force, on the paper 12 being tightly fixed by the paper holding plate 20, to a certain extent even under such undesirable conditions as: unsuitable paper type; bad ambient atmosphere; and deteriorated cutting quality of the cutting portion 18 of the movable blade 16. As a result, the durability of the cutting portion 18 of the movable blade 16 will increase.

The above-mentioned present invention can be applied not only to the cutting operation, but also to the perforated line formation of the recording paper 12.

Further, the provision of the paper holding plate 20 on the movable blade 16 can be on one side or on both sides of the blade 16.

Also it is preferable to make the paper holding plate 20 itself or its distal end 20*a*, of material having a large friction coefficient.

As mentioned above, according to the cutter apparatus of this invention, it is possible to cut the recording paper while it is in a tightly fixed state. The paper does not move with the movable blade toward the opening to be pressed thereinto, thus remaining in an uncut state. In consequence, the movable blade can perform a stable cutting operation, irrespective of the paper type or ambient atmospheric conditions or even when its cutting quality is deteriorated to a certain extent, thereby increasing its durability.

What is claimed is:

1. A paper handling apparatus, comprising:

(a) a paper feeding guide for guiding paper in a feeding direction, said paper feeding guide having a striation-like opening formed across the width thereof, said striation-like opening forming a fixed blade;

(b) a movable blade having a distal cutting portion which enters into the opening in a cutting direction and thereby cooperates with said fixed blade to cut the paper; wherein said movable blade has a first drive guide groove formed therein;

(c) a paper holding plate provided on only one side of said movable blade, said paper holding plate being slidable in the cutting direction relative to the movable blade, said paper holding plate having a distal end for firmly holding the paper against the paper feeding guide;

(d) a sliding mechanism which: keeps the distal end of said paper holding plate projected forward in the cutting direction further than the distal cutting portion of said movable blade; slides the movable blade and the paper holding plate in the cutting direction; and, with the distal end of said paper holding plate firmly holding the paper against the paper feeding guide, further slides the movable blade into the opening to cut the paper; and wherein said sliding mechanism includes an urging means for urging said paper holding plate continuously in the cutting direction relative to the movable blade; and (e) paper feed means for feeding the paper in the feeding direction and for fixing the paper in place to prevent the paper from moving in the feeding direction when said movable blade is moved in said cutting direction to cut the paper, said paper feed means being located on the opposite side of said movable blade from said paper holding plate, whereby the paper is fixedly held in place by only said paper holding plate and said feed means when said movable blade is moved in said cutting direction to cut the paper; and wherein said paper holding plate has a projecting portion engageable with the guide groove of said movable blade and slidable in the guide groove in accordance with the movement of said sliding mechanism; and wherein said projecting portion of said paper holding plate is a dimple formed by applying a half blanking process in a part of the paper holding plate.

2. A cutter apparatus according to claim 1, wherein said sliding mechanism comprises:

a driving gear connected to a motor;

a driving pin projectingly mounted on said driving gear;

a drive guide groove formed in said movable blade to receive said driving pin moving therein in accordance with the rotation of said driving gear.

3. A cutter apparatus according to claim 1, wherein said urging means includes at least one compression energizing spring located on said paper holding plate.

4. A cutter apparatus according to claim 1, wherein the movable blade is adapted to cut a line of perforation such that the operation of the apparatus in the cutting of the paper results in a perforated line being formed.

5. A paper handling apparatus, comprising:

(a) a paper feeding guide for guiding paper in a feeding direction, said paper feeding guide having a striation-like opening formed across the width thereof, said striation-like opening forming a fixed blade;

(b) a movable blade having a distal cutting portion which enters into the opening in a cutting direction and thereby cooperates with said fixed blade to cut the paper; wherein said movable blade has a first drive guide groove formed therein;

(c) a paper holding plate provided on only one side of said movable blade, said paper holding plate being slidable in the cutting direction relative to the movable blade, said paper holding plate having a distal end for firmly holding the paper against the paper feeding guide; and (d) a sliding mechanism which: keeps the distal end of said paper holding plate projected forward in the cutting direction further than the distal cutting portion of said movable blade; slides the movable blade and the paper holding plate in the cutting direction; and, with the distal end of said paper holding plate firmly holding the paper against the paper feeding guide, further slides the movable blade into the opening to cut the paper; and wherein said sliding mechanism includes an urging means for urging said paper holding plate continuously in the cutting direction relative to the movable blade; and wherein said paper holding plate has a projecting portion engageable with the guide groove of said movable blade and slidable in the guide groove in accordance with the movement of said sliding mechanism; and wherein said projecting portion of said paper holding plate is a dimple formed by applying a half blanking process in a part of the paper holding plate.

* * * * *